US005775161A

United States Patent [19]

Caleffi et al.

[11] Patent Number: 5,775,161

[45] Date of Patent: Jul. 7, 1998

[54] STAGGERED DIE METHOD AND APPARATUS FOR NECKING CONTAINERS

[75] Inventors: Antonio Caleffi, deceased, late of Nogara, Italy, by Gianfranco Caleffi, executor; William A. Hecimovich, Northampton, England; Timothy R. Wright, Narlidere Izmir, Turkey; Leo F. Hayden, Fox River Grove, Ill.

[73] Assignee: American National Can Co., Chicago, Ill.

[21] Appl. No.: 743,847

[22] Filed: Nov. 5, 1996

[51] Int. Cl.[6] ..... B21D 51/26

[52] U.S. Cl. ..... 72/356; 72/379.4; 413/69

[58] Field of Search ..... 72/94, 352, 356, 72/379.4; 413/69

[56] References Cited

U.S. PATENT DOCUMENTS

| | | | |
|---|---|---|---|
| D. 271,281 | 11/1983 | Abbott . | |
| 2,741,292 | 4/1956 | Butters | 72/94 |
| 3,029,507 | 4/1962 | Gaggini . | |
| 3,687,098 | 8/1972 | Maytag . | |
| 3,964,413 | 6/1976 | Saunders . | |
| 4,173,883 | 11/1979 | Boik . | |
| 4,266,685 | 5/1981 | Lee, Jr. . | |
| 4,280,353 | 7/1981 | Murphy . | |
| 4,316,375 | 2/1982 | Lee, Jr. . | |
| 4,341,103 | 7/1982 | Escallon . | |
| 4,403,493 | 9/1983 | Atkinson . | |
| 4,441,354 | 4/1984 | Bodega . | |
| 4,446,714 | 5/1984 | Cvacho . | |
| 4,457,158 | 7/1984 | Miller . | |
| 4,512,172 | 4/1985 | Abbott . | |
| 4,519,232 | 5/1985 | Traczyk . | |
| 4,563,887 | 1/1986 | Bressan . | |
| 4,606,207 | 8/1986 | Slade . | |
| 4,693,108 | 9/1987 | Traczyk . | |
| 4,732,027 | 3/1988 | Traczyk . | |
| 4,753,364 | 6/1988 | Stoffel . | |
| 4,760,725 | 8/1988 | Halasz . | |
| 4,774,839 | 10/1988 | Caleffi et al. | 72/356 |
| 4,781,047 | 11/1988 | Bressan . | |
| 5,018,374 | 5/1991 | Montano . | |
| 5,018,379 | 5/1991 | Shirai . | |
| 5,076,087 | 12/1991 | Slater . | |
| 5,138,858 | 8/1992 | Johnson . | |
| 5,282,375 | 2/1994 | Lee, Jr. . | |
| 5,297,414 | 3/1994 | Sainz | 72/356 |
| 5,355,710 | 10/1994 | Diekhoff . | |
| 5,448,903 | 9/1995 | Johnson . | |
| 5,469,729 | 11/1995 | Hager . | |
| 5,497,900 | 3/1996 | Caleffi . | |
| 5,553,826 | 9/1996 | Schultz . | |
| 5,557,963 | 9/1996 | Diekhoff . | |

*Primary Examiner*—Lowell A. Larson

[57] ABSTRACT

A necking apparatus for producing a smooth, inwardly tapered necked-in portion on a cylindrical container includes a plurality of necking modules and a turret which is rotatably mounted in each module about an axis of rotation. Each turret includes an upper turret frame which is mounted on the axis of rotation and which can be moved axially relative to the turret and a lower turret frame. A plurality of necking dies are mounted on the upper turret frame, and a plurality of container supports are axially aligned with the necking dies and are mounted on the lower turret frame for axial movement. Each necking die includes a necking portion for engaging and necking a side wall of a container as the aligned container support moves a container toward the necking die. The positions of the necking dies are adjusted by spacers so that the necking portion of each die does not engage the tapered necked-in portion of the container as the container support is moved toward the die.

15 Claims, 5 Drawing Sheets

STAGGERED DIE METHOD AND APPARATUS FOR NECKING CONTAINERS

BACKGROUND

This invention relates to smooth die-necked containers and to the method and apparatus for necking such containers. More particularly, the invention is an improvement over the method and apparatus which is described in U.S. Pat. Nos. 4,774,839 and 5,497,900.

As described in said patents, two-piece cans are the most common type of metal containers used in the beer and beverage industry and also are used for aerosol and food packaging. They are usually formed of aluminum or tin-plated steel. The two-piece can consists of a first cylindrical can body portion having an integral bottom end wall and a second, separately-formed, top end panel portion which, after the can has been filled, is double-seamed thereon to close the open upper end of the container.

In most cases, containers used for beer and carbonated beverages have an outside diameter of 2 11/16 inches (referred to as a 211-container) and are reduced to open end diameters of (a) 2 9/16 inches (referred to as a 209-neck) typically in a single-necking operation for a 209 end; or, (b) 2-(7.5)/16 (referred to as a 207.5 neck) typically in a double-necking operation for a 207.5 end; or, (c) 2 6/16 (referred to as a 206-neck) in a smooth triple- or quad-necking operation for a 206 end. Smaller diameter ends can be used, e.g., 204, 202, 200 or smaller. Further, different can fillers use cans with varying neck size. Hence, it is very important for the can manufacturer to quickly adapt its necking machines and operations from one neck size to another.

As described in U.S. Pat. Nos. 4,774,839 and 5,497,900, as the can passes through the apparatus after an initial operation, each of the die necking operations partially overlaps and reforms only a part of a previously-formed portion to produce a necked-in portion on the end of the cylindrical side wall until the necked-in portion extends the desired length. This process produces a smooth, tapered annular wall portion between the cylindrical side wall and the reduced diameter cylindrical neck portion. The tapered annular wall portion which has arcuate portions on either end may be characterized as the necked-in portion or taper between the cylindrical side wall and the reduced diameter neck.

The cylindrical neck merges with the cylindrical side wall through a generally smoothly tapered neck portion. The tapered neck portion between the cylindrical neck portion and the cylindrical container side wall initially is defined by a lower, generally arcuate segment having a relatively large internal curvature at the upper end of the cylindrical side wall and an upper, generally arcuate segment having a relatively large external curvature at the lower end of the reduced cylindrical neck.

A further tapered portion is then formed at the open end and is forced downwardly while the cylindrical neck is further reduced. The further tapered portion freely integrates with the second arcuate segment which is reformed and the tapered portion is extended. This process is repeated sequentially until the cylindrical neck is reduced to the desired diameter and a smoothly tapered necked-in portion is formed on the end of the side wall. In each necking operation, the tapered portion is not constrained by the die and is freely formed without regard to the specific dimensions of the die transition zone.

The container that is formed by the above die necking process has an aesthetically pleasing appearance, greater strength and crush resistance, and is devoid of the scratches or wrinkles in the neck produced in the spin necking operation.

Each container necking operation is preferably performed in a necking module consisting of a turret which is rotatable about a fixed vertical axis. Each turret has a plurality of identical exposed necking substations on the periphery thereof with each necking substation having a stationary necking die, a form control member reciprocable along an axis parallel to the fixed axis for the turret, and a platform being movable by cams and cam followers, as also explained in U.S. Pat. No. 4,519,232.

The second or upper arcuate segment CR in FIGS. 6–11 of the '839 and '900 patents, which is the upper part of the necked-in portion, is reformed in each subsequent necking operation while the tapered portion is enlarged. At the same time, the first arcuate segment CA, while not being positively reformed by the die, will have a change in its radius of curvature due to a free forming resulting from the inherent spring back characteristics of the metal. The dies in the third and fourth operations have flat tapered surfaces T but the tapered wall segment CT is not formed in the container until the fifth and sixth necking operations. This is believed to result from the free forming of the necked-in portion rather than conforming the necked-in portion to the die.

Although each die reforms only an upper portion of the tapered neck, the die engages substantially the entire outer surface of the tapered neck as the container is moved axially to its uppermost position. The tapered neck portion which is formed by each die therefore forms an included angle with the axis of the container which is substantially the same as the included angle between the die and the axis of the container.

SUMMARY OF THE INVENTION

The invention spaces or staggers the dies farther away from the container supports so that the necking portion of each die engages only the cylindrical portion of the neck and does not engage the tapered portion of the neck. The dies of successive necking modules are preferably staggered or cascaded, i.e., each die is spaced a greater distance from the container support than the die of the previous module.

The staggered dies reduce the axial loads on the container and thereby reduce pleating of the container wall and reduce the tendency of the bottom of the container to become squat or deformed. The staggered dies also enable better control of container height and flange width.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
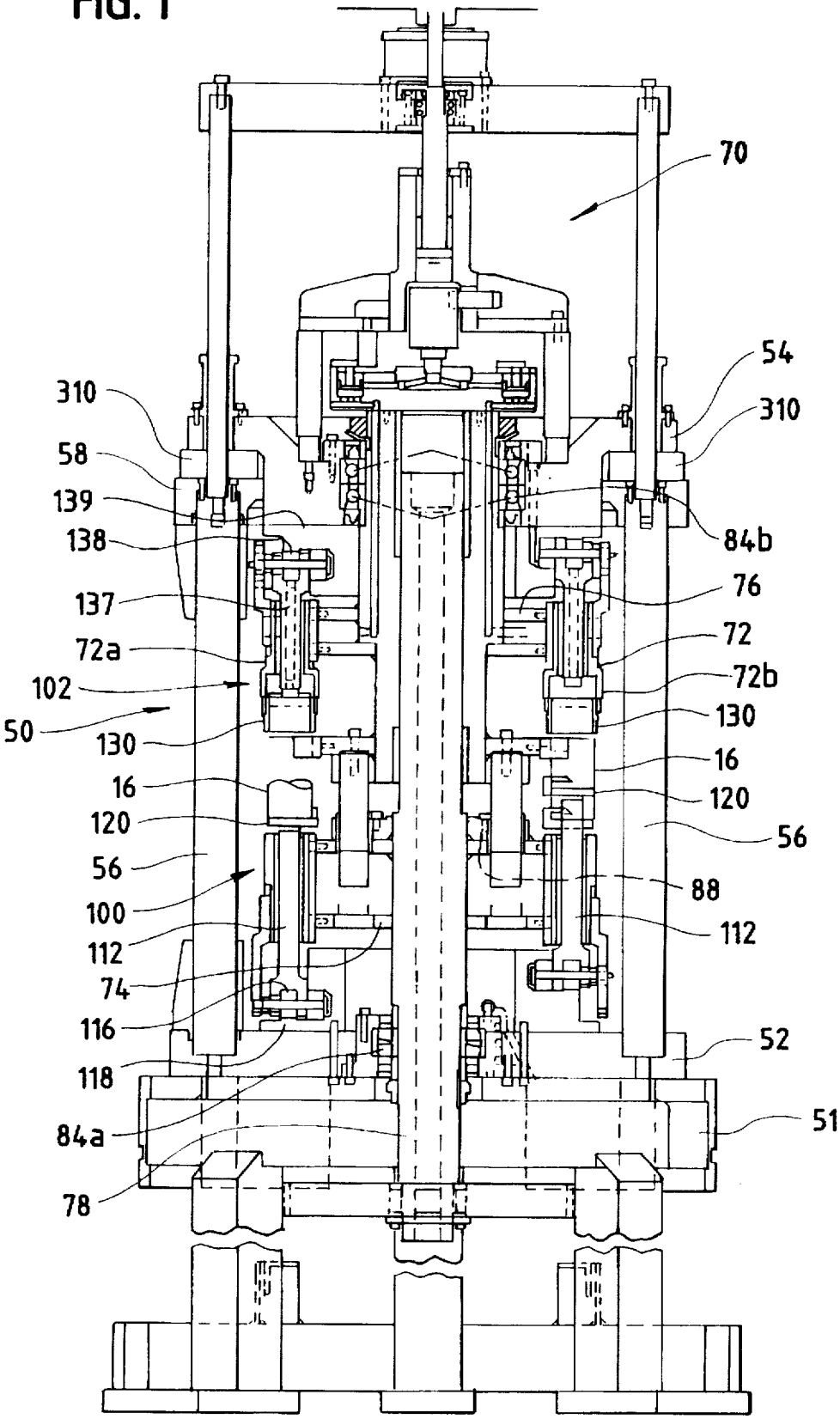
FIG. 1 is a fragmentary sectional view of a necking apparatus formed in accordance with the invention.

FIG. 1 illustrates one of the necking modules of a necking apparatus of the type which is described in U.S. Pat. Nos. 4,774,839 and 5,497,900 but which has been modified in accordance with the invention. Except for the modifications which are described herein, the necking apparatus of this invention is substantially identical to the necking apparatus of the '839 and '900 patents, and the disclosures of those patents are incorporated herein by reference. For the sake of clarity like reference numerals will be used for like parts. The apparatus illustrated in FIG. 1 is known as a 5811-2 necker machine.

Each necking module of the necking apparatus includes a frame 50 and a rotary turret assembly 70 that holds a plurality of identical necking substations 72 around the periphery thereof. FIG. 1 illustrates two of the substations 72*a* and 72*b*. The module frame 50 includes a base 51 and lower and upper frame members 52 and 54 which are interconnected by columns 56.

A lower turret frame 74 and an upper turret frame 76 are supported on a central drive shaft 78 that extends through openings in frame members 52 and 54. Turret assembly 70 is rotatably supported on the frame members by bearings 84*a* and 84*b*. The upper turret frame 76 is slidable axially on drive shaft 78 and is secured in the desired axial position by a collar 88.

Figure 2:
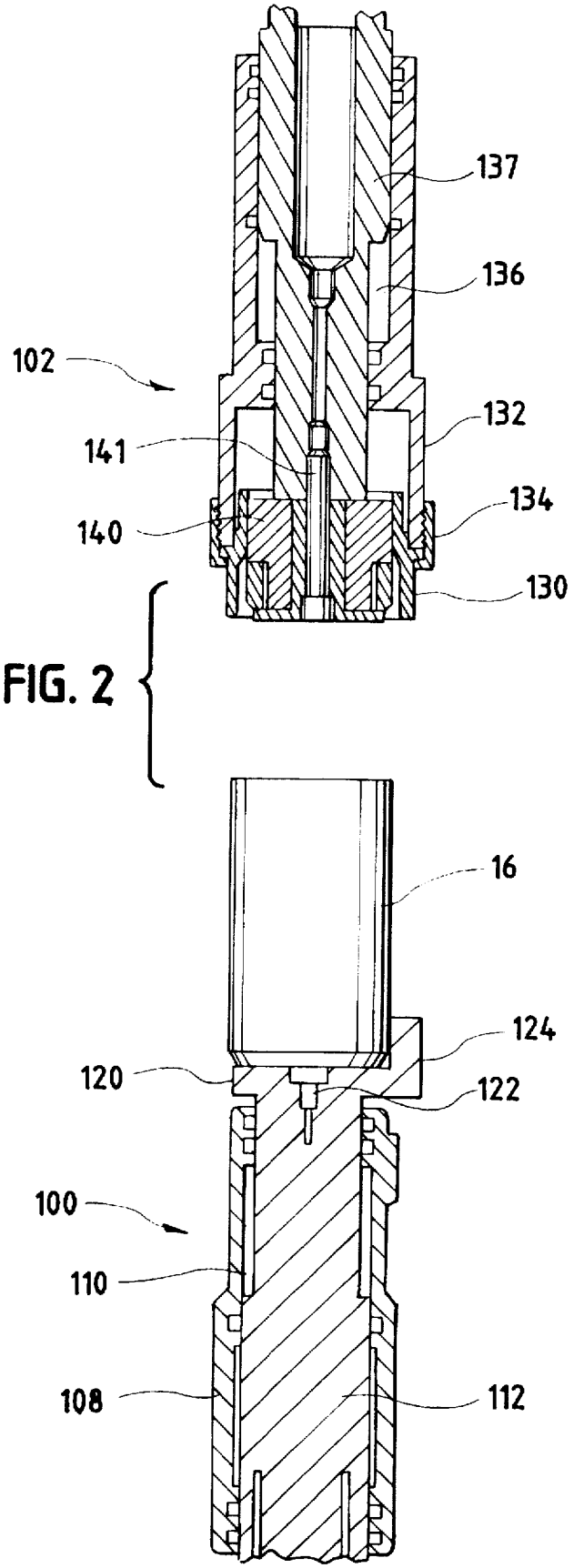
FIG. 2 is an enlarged fragmentary sectional view of a portion of FIG. 1.

FIG. 2 discloses in greater detail necking substation 72 comprising a lower container-lifting portion, generally indicated at 100, and an upper forming or necking portion, generally indicated at 102. Referring now to both FIGS. 1 and 2, the container-lifting portion 100 includes an outer cylindrical member or sleeve 108 that has a generally circular opening 110 with a ram or piston 112 reciprocably movable in the opening 110. The lower end of ram 112 has a cam follower 116 (see FIG. 1) which rides on an upper exposed camming surface of a face cam 118 supported on lower frame member 52. The upper end of ram 112 has a container supporting platform 120 secured thereto by fastener means 122. The support platform or container support means has an inner upwardly-arcuate extension 124 for engaging the inner lower surface of container 116. Ram 112 cooperates with sleeve 108 to provide both a fluid centering mechanism and to bias the cam followers 116 into engagement with the cam 118, as described in more detail in U.S. Pat. No. 4,519,232, incorporated herein by reference.

The cam 118 essentially comprises a fixedly-mounted ring circumferentially seated on lower frame member 52. The cam is of selected height and configuration and aligned with the lower end of the substations 72 to control the upward and downward movement of the piston 112 and hence of the container 16 as the turret is rotated on the fixed frame 50. Since the cam followers 116 are biased into engagement with the cam 118, the configuration of the camming surface of the face cam will dictate the position of the container 16, as will be described later.

The upper necking portion 102 includes a necking die element 130 that is secured to a hollow cylinder 132 by means of a threaded cap 134. The cylinder 132 has an axial opening 136 in which a hollow plunger or shaft 137 is reciprocally mounted. A cam follower 138 (see FIG. 1) is mounted on the upper end of shaft 137 and rollably abuts on an exposed camming surface of a fixed upper face cam 139 secured to upper frame member 54.

Plunger 137 and cam follower 138 are maintained in engagement with the cam 139 by fluid pressure which also centers the shaft 137 in the opening 136, all as explained in U.S. Pat. No. 4,519,232. The lower end of plunger 137 supports a form control member 140, as described in the '839 and '900 patents. Also, the plunger 137 and the form control member 140 have an opening 141 for introducing pressurized air into the container during the necking operation, as will be explained later.

In operation of the module, shaft 78 is caused to rotate about a fixed axis on the stationary frame 50. Containers 16 are moved onto the platform 120 and into engagement with arcuate extension 124 when the lower lifting portion is in the lower-most position, shown in substation 72*a* at the left-hand side of FIG. 1. The configuration of the lower cam 118 is such that the container is moved up into the die 130 as the shaft 78 is rotated, and the upper open end of the container is thereby incremently reformed. At about the time the upper edge of the container contacts the die 130, pressurized air is introduced into the container from a source (not shown) through opening 141. As the turret assembly 70 is rotated about 120° of turret rotation, the upper cam 139 is configured to allow the form control member 140 to move upwardly based on the configuration of the cam. As mentioned above, shaft 137 including the form control member 140 is biased upwardly by fluid pressure, and will move upwardly as the turret assembly rotates. Thereafter, during the remainder of the 360° rotation, the cams 118 and 139 are configured to return the platform 120 and form control member 140 to their lower-most positions at substantially matched speeds while the necked container is removed from the die. During this downward movement, the pressurized air in the container will force the container from the die onto the platform 120. Containers 16 are continually being introduced onto platform 120, processed, and removed as described in the '839 and '900 patents.

In the method and apparatus described in the '839 and '900 patents, a container is necked to have a smaller opening by utilizing a plurality of necking modules. In the particular embodiment described, for a 202 size neck ten different necking operations and one flanging operation are performed on the neck of the container. An upper part of the necked-in or inwardly-tapered portion is reshaped during each of the necking operations. In each necking operation, a small overlap is created between a previously necked-in portion while the overall necked-in portion is extended and axially enlarged and small segments of reduction are taken so that the various operations blend smoothly into the finished necked-in portion. The resultant necked-in portion has a rounded shoulder on the end of the cylindrical side wall which merges with an inwardly-tapered annular straight segment through an arcuate portion. The opposite end of the annular straight segment merges with the reduced cylindrical neck through a second arcuate segment.

However, even though each of the dies in the '839 and '900 apparatus reforms only an upper portion of the tapered neck, the tapered necking portion of the die of each necking substation contacts the entire tapered neck of the container when the container is in its uppermost position. We have found that substantial improvements can be obtained if the tapered portion of the die does not contact the entire neck of the container but contacts only an upper portion of the neck. Preferably, the necking portion of the die contacts only the reduced-diameter cylindrical portion and adjacent forming radius of the neck and not the tapered portion of the neck. Axial loads on the container are thereby reduced, pleating of the container is reduced, and there is less likelihood that the bottom of the container will be squat or deformed. The invention also provides better control of the height variation of the necked container and of the width of the flange.

Reducing the amount of engagement between the dies and the neck of the container is accomplished by staggering or cascading the spacing between the dies of the necking substation relative to the container supporting platforms 120. Referring to FIG. 1, the necking module of the '839 and '900 patents are modified by removable spacers 310 for a 5811-2 necker machine which are positioned between the collars 58 on the columns 56 and the upper frame member 54. The axial position of the upper turret frame 76 along the drive shaft 78 can thereby be varied in order to control the spacing of the dies 130 relative to the container support platforms 120.

The axial dimension of the spacers of each substation is selected so that when the container is in its uppermost position in the die, the tapered necking portion of the die does not engage the entire neck of the container. Preferably, the tapered necking portion of the die engages only the reduced-diameter cylindrical portion and the adjacnet forming radius of the neck which extends above the tapered portion of the neck (compare FIG. 6 with the right sides of FIGS. 7–11 of the '839 and '900 patents).

Figure 3:
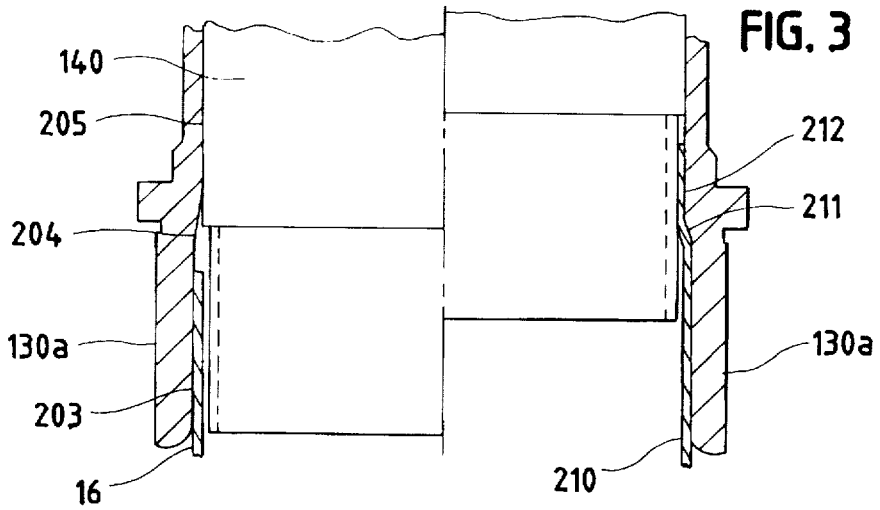
FIG. 3 illustrates the initial step of forming the neck.

FIG. 3 illustrates the first necking operation which is performed in the first necking module. The left side of FIG. 3 shows a container 16 being moved upwardly into a necking die 130*a*. The necking die has a first cylindrical wall portion 203, a tapered necking portion 204, and a second cylindrical wall portion 205. The first cylindrical wall portion 203 has a diameter approximately equal to the external diameter of the container 16 with a clearance of about 0.006 inch. The second cylindrical wall portion 205 has a reduced diameter equal to the external diameter of the reduced neck that is being formed in the first necking operation.

As the container 16 is moved upwardly into the die 130*a*, as shown on the right side of FIG. 3, the diameter of the container neck is reduced, and a tapered neck portion 211 is formed on the container body between the cylindrical side wall 210 and the reduced cylindrical neck portion 212.

In the first necking operation, the diameter of the neck is reduced only a very small amount, e.g., about 0.069 inch, while the portion of the container to be necked is conditioned for subsequent operations.

Figure 4:
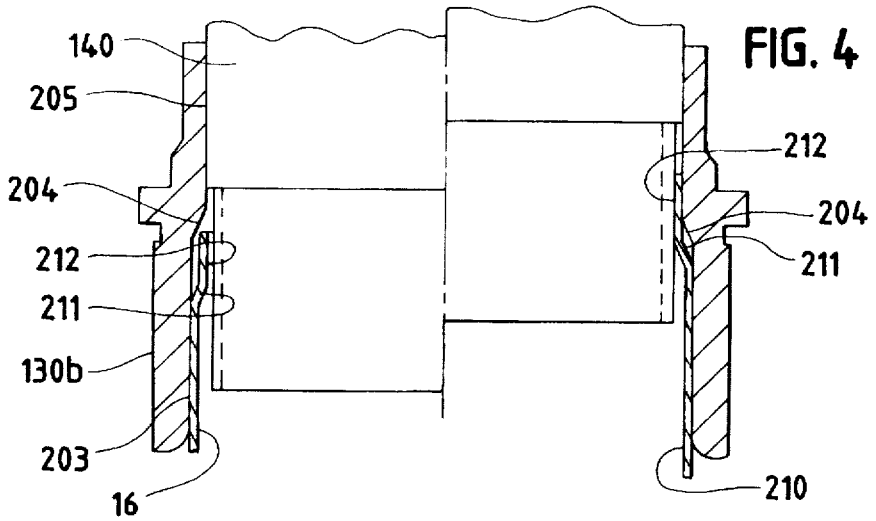
FIGS. 4 and 5 illustrate subsequent necking operations.

FIG. 4 illustrates a subsequent necking operation which is performed in one of the subsequent necking modules. A necking die 130*b* includes a first cylindrical surface 203, having a diameter approximately equal to the center diameter of the container, a tapered neck portion 204, and a reduced diameter cylindrical surface 205. As the container 16 is moved upwardly, the cylindrical neck portion 212 engages the tapered necking portion 204 of the die and is forced radially inwardly.

Figure 6:
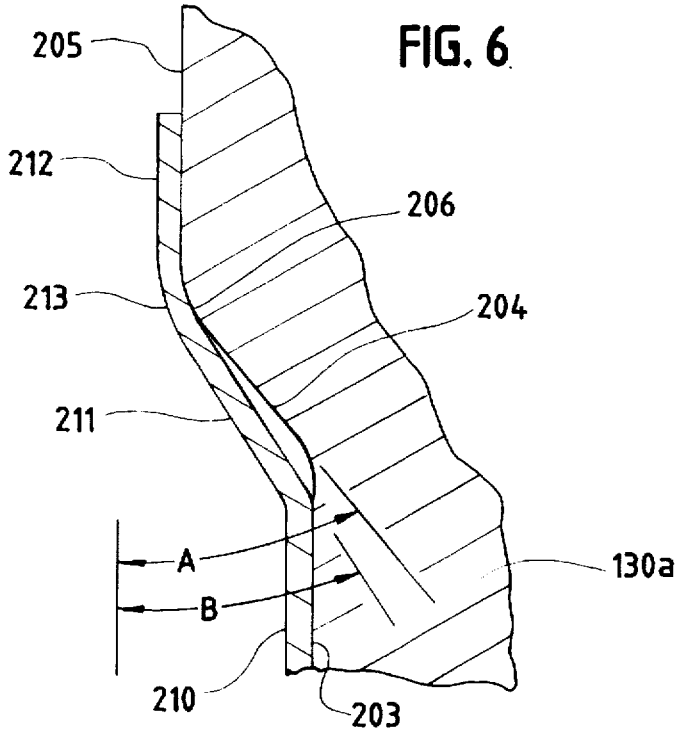
FIG. 6 is an enlarged fragmentary sectional view of a portion of FIGS. 4 and 5.

The container 210 is shown in its uppermost position in the right hand side of FIG. 4 and in the enlarged view of FIG. 6. The tapered neck portion 211 of the container is spaced below the tapered necking portion 204 of the die by the spacers 310, and the necking portion 204 does not engage the tapered neck portion 211 of the container. The necking portion 204 of the die may contact the forming radius 213 (FIG. 6) which joins the tapered portion 211 and the cylindrical neck 212 of the container. More particularly, the radiused portion 206 of the die engages and reforms the upper portion of the neck as the container moves upwardly.

Figure 5:
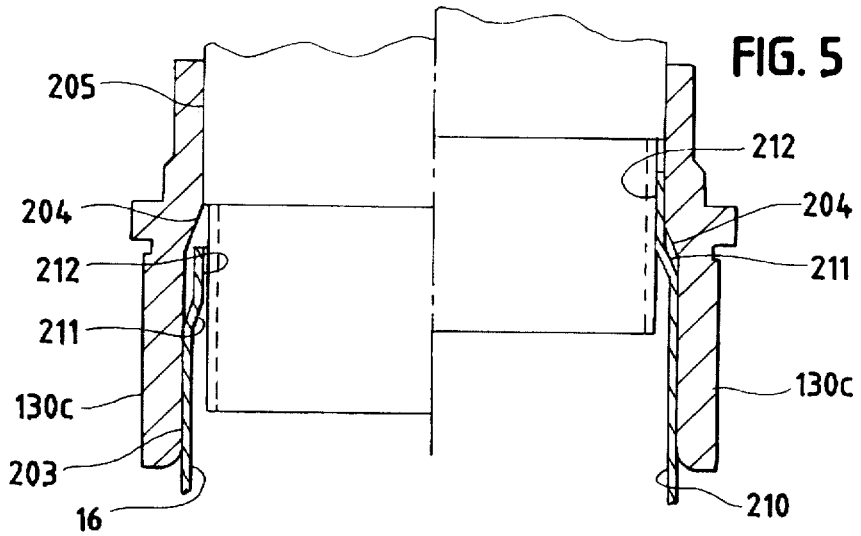

The axial dimension of the gap between the tapered necking portion 204 of the die and the tapered neck portion 211 of the container is exaggerated in FIGS. 4 and 5 for the purpose of illustration. The actual gap is more accurately illustrated in the enlarged view of FIG. 6. The axial dimension of the gap in the preferred embodiment of the invention is only about 0.005 inch. The tapered necking portion 204 of the die forms an angle A with the longitudinal axis of the container, and the tapered neck 211 of the container forms an angle B with the longitudinal axis. In the preferred embodiment the angle A was 33° and the angle B was 30°3'47".

Even though the tapered necking portion 204 of the die does not engage the tapered neck 211 of the container, the upper portion of the necked-in portion of the container, consisting of the tapered portion 211 and the cylindrical portion 212, is reformed, and the length of the tapered neck 211 is increased.

FIG. 5 illustrates a necking operation subsequent to the necking operation illustrated in FIG. 4. A necking die 130*c* includes a cylindrical side wall 203 having a diameter approximately equal to the outer diameter of the container 16, a tapered necking portion 204, and a second cylindrical wall portion 205. The container 16 includes a tapered neck portion 211 and a cylindrical neck portion 212. As the container moves from the position illustrated on the left of FIG. 5 to its uppermost position illustrated on the right of FIG. 5 and in FIG. 6, the cylindrical neck 212 of the container engages the tapered necking portion 204 of the die and is reformed, thereby lengthening the tapered neck 211 of the container. The spacers 310 prevent the tapered necking portion 204 of the die from engaging the tapered neck 211 of the container when the container is in its uppermost position, and only the cylindrical neck portion 212 and the forming radius 213 (FIG. 6) of the container is engaged by the necking portion 204 of the die.

Figure 7:
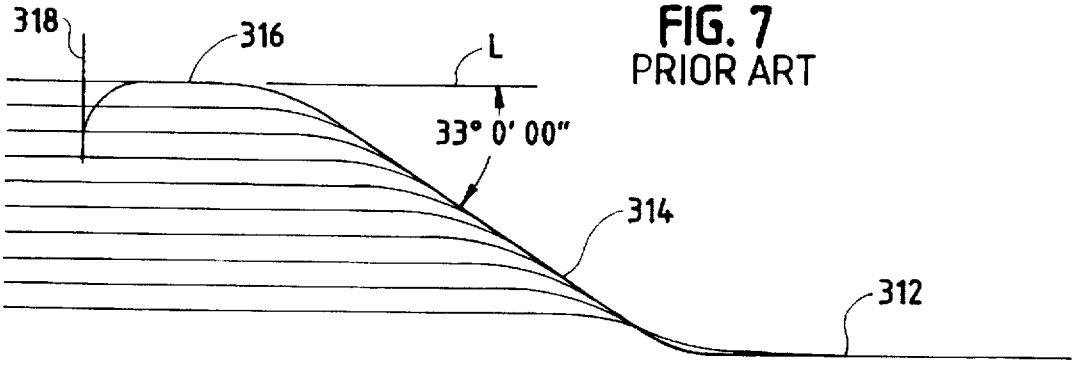
FIG. 7 PRIOR ART
FIG. 7 illustrates the prior art configuration of a neck formed by the apparatus described in U.S. Pat. Nos. 4,774,839 and 5,497,900.

FIG. 7 illustrates the 10 necking operations which are performed by the apparatus described in the '839 and '900 patents to form a 202 size neck on a 211 container. The container has a cylindrical side wall 312, a smooth tapered neck portion 314, a cylindrical neck 316, and a flange 318. The tapered neck 314 forms an included angle of about 33° relative to a line L which extends parallel to the longitudinal axis of the container. The necking portion 204 of each of the necking dies also has an angle of about 33° relative to the longitudinal axis of the die.

Figure 8:
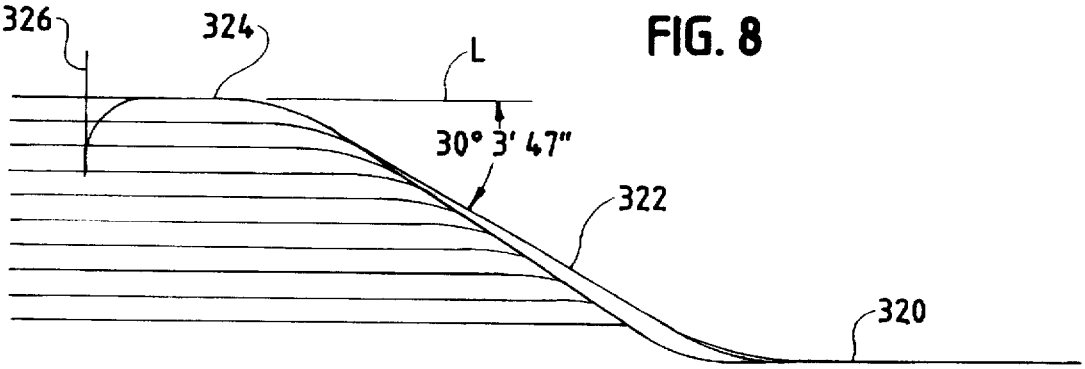
FIG. 8 illustrates a neck formed by the staggered die apparatus of the invention using the same dies as the apparatus which was used for FIG. 7.

FIG. 8 illustrates the 10 necking operations which are performed on an apparatus which is modified in accordance with the invention by adding the spacers 310 for 5811-2 necker machine in order to maintain the necking portion 204 of each die above the tapered neck of the container when the container is in its uppermost position in the die. The container similarly includes a cylindrical side wall 320, a smooth tapered neck 322, a cylindrical neck 324, and a flange 326. However, since the tapered neck of the container is not engaged by the tapered necking portion of the die during the necking operations, the angle of the tapered neck relative to the line L which extends parallel to the axis of the container is less than the angle of the tapered neck 314 in FIG. 6. Even though the necking portions of the dies which were used to form the container of FIG. 7 formed an angle of 33° relative to the axis of the dies, the angle of the tapered neck 322 was only about 30°3'47".

Figure 9:
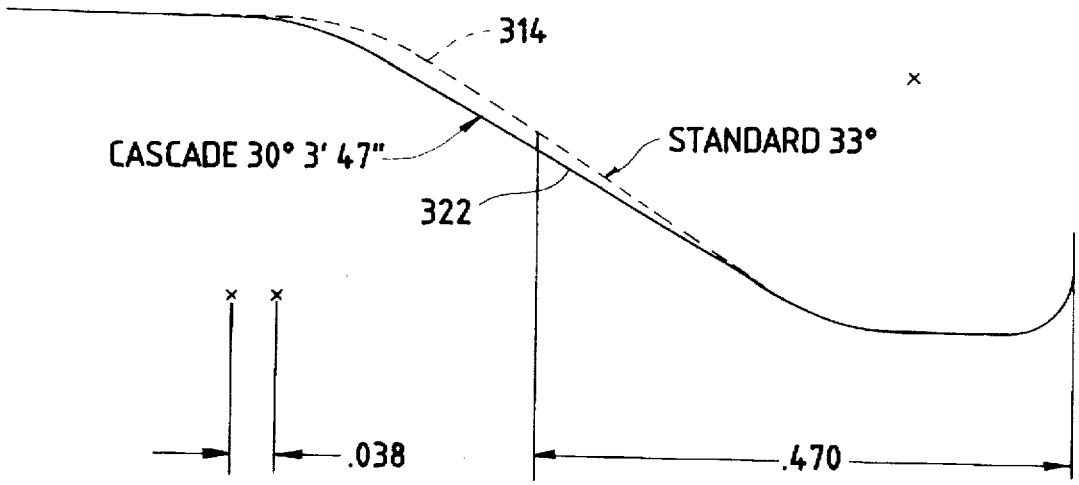
FIG. 9 compares the neck of FIG. 7 and the neck of FIG. 8.
Figure 10:
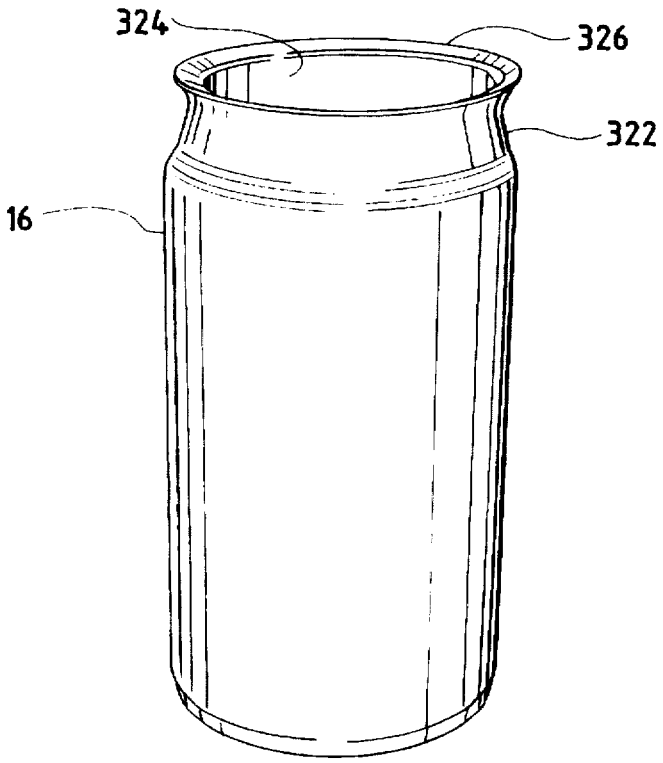
FIG. 10 shows a finished necked and flanged container.

FIG. 9 compares the tapered neck of FIG. 7 (shown in dashed outline, with the tapered neck of FIG. 8, shown in solid outline). Although the diameter of the cylindrical wall portions of the two containers and the diameters of the cylindrical neck portions of the two cans are the same, the angle of the tapered neck portion 322 is less than the angle of the tapered neck portion 314.

Table 1 illustrates specific spacer thicknesses for 10 necking operations for forming a 202 size neck on a 211 diameter container. One of the containers was aluminum and had a can height of 4.812 inch and a capacity of 12 ounces. The other container was aluminum and had a can height of 4.535 inch and a capacity of 33 centiliters. Spacers having different thicknesses were used in four different style necking machines, designated as 588, 589, 5811, and 5811-2 neckers. After the first necking operation, the thickness of the spacers increased by 0.005 inch for each operation in order to accommodate the increased length of the smooth tapered neck of the container.

Table 2 lists the dimensions for the spacers used in 14 necking operations to produce a 202 size neck on a 211 diameter steel can having a can height of 4.535 inch and a capacity of 33 cl. After the second necking operation, the thickness of the spacers increased 0.005 inch for each operation.

TABLE 1

| | 211/202 × 413 (Alum.) (12 oz.) | | 211/202 × 408.5 (Alum.) (33 cl) | |
|---|---|---|---|---|
| Operation | 5811 Necker Spacer (inches) | 5811-2 Necker Spacer (inches) | 5811 Necker Spacer (inches) | 5811-2 Necker Spacer (inches) |
| 1st | 1.185 | 1.677 | 0.904 | 1.400 |
| 2nd | 1.183 | 1.675 | 0.902 | 1.398 |
| 3rd | 1.188 | 1.680 | 0.907 | 1.403 |
| 4th | 1.193 | 1.685 | 0.912 | 1.408 |
| 5th | 1.198 | 1.690 | 0.917 | 1.413 |
| 6th | 1.203 | 1.695 | 0.922 | 1.418 |
| 7th | 1.208 | 1.700 | 0.927 | 1.423 |
| 8th | 1.213 | 1.705 | 0.932 | 1.428 |
| 9th | 1.218 | 1.710 | 0.937 | 1.433 |
| 10th | 1.223 | 1.715 | 0.942 | 1.438 |

TABLE 2

| | 211/202 × 408.5 (steel) (33 cl) | |
|---|---|---|
| Operation | 5811 Necker Spacer (inches) | 5811-2 Necker Spacer (inches) |
| 1st | 0.887 | 1.383 |
| 2nd | 0.880 | 1.376 |
| 3rd | 0.887 | 1.383 |
| 4th | 0.892 | 1.388 |
| 5th | 0.897 | 1.393 |
| 6th | 0.902 | 1.398 |
| 7th | 0.907 | 1.403 |
| 8th | 0.912 | 1.408 |
| 9th | 0.917 | 1.413 |
| 10th | 0.922 | 1.418 |
| 11th | 0.927 | 1.423 |
| 12th | 0.932 | 1.428 |
| 13th | 0.937 | 1.433 |
| 14th | 0.942 | 1.438 |

While in the foregoing specification a detailed description of specific embodiments of the invention was set forth for the purpose of illustration, it will be understood that many of the details herein given can be varied considerably by those skilled in the art without departing from the spirit and scope of the invention.

We claim:

1. A necking apparatus for producing a smooth inwardly tapered necked-in portion adjacent an open end of a container having a generally cylindrical side wall comprising:

a plurality of necking modules, each of the necking modules including a module frame and a turret rotatably mounted on the module frame for rotation about a fixed axis, the turret of each of the modules including a drive shaft rotatably mounted on the module frame, an upper turret frame mounted on the drive shaft, a lower turret frame mounted the drive shaft, and a plurality of necking substations mounted on the upper and lower turret frames, each of the necking substations including an annular necking die mounted on the upper turret frame, the necking die having a first cylindrical wall surface substantially equivalent in diameter to the container side wall and a second cylindrical wall surface of lesser diameter and a tapered neck extending between the first and second cylindrical wall surfaces, a container support mounted on the lower turret frame in axial alignment with a necking die, and cam means for producing relative axial movement between the necking die and the container support, between a first position in which the necking die and the container support are a maximum distance apart and a second position in which the necking die and the container support are a minimum distance apart, the improvement comprising means for varying the axial spacing between the upper turret frame and the lower turret frame of each of the turrets whereby the axial spacing between each necking die of the turret and the associated container support may be varied so that when the necking die and the container support are in the second position the tapered neck of the necking die does not engage the tapered necking-in portion of a container supported by the container.

2. The apparatus of claim 1 in which the spacing means of each turret has a different axial dimension and varies the spacing between the upper and lower turret frames by a different amount.

3. The apparatus of claim 2 in which the axial dimension of the spacers for a plurality of consecutive modules vary by about 0.005 inch for each module.

4. The apparatus of claim 1 in which each of the module frames includes a plurality of axially extending support columns, the upper turret frame of each module being axially slidably supported by the support columns, and means on the columns for supporting the upper turret frame, said spacing means being positioned between the support means on the column and the upper turret frame.

5. A method of necking an open end of a cylindrical container side wall to form a smooth inwardly tapered necked-in portion and a reduced diameter cylindrical portion which extends from the cylindrical side wall comprising the steps of:

providing a plurality of necking modules, rotatably supporting a turret in each of the modules for rotation about an axis, each of the turrets having a plurality of axially movable container supports, a plurality of necking dies which are axially aligned with the container supports and mounted on the turret for axial movement, each of the necking dies having a necking portion for engaging and necking a container side wall, each necking portion including a generally cylindrical wall surface, a tapered neck, and a radiused surface between the cylindrical wall surface and the tapered neck, and cam means for axially moving each of the container supports between a first position in which the container support is a maximum axial distance from the aligned necking die and a second position in which the container support is a minimum distance from the aligned necking die whereby the side wall of a container on the container support is moved into engagement with the necking portion of the aligned necking die, and adjusting the axial position of each of the necking dies so that the tapered neck of the die is axially spaced from the necked-in portion of a container when the aligned container support is in its second position, and moving each of the container supports to its second position whereby the necking portion of the aligned die engages only the reduced diameter portion of a container and the tapered neck does not engage the necked-in portion of the container.

6. The method of claim 5 in which said adjusting step comprises mounting spacers on the necking module frames for moving the necking dies axially away from the container supports.

7. The method of claim 5 in which said adjusting step includes adjusting the axial position of the necking dies of each turret by a different amount.

8. The method of claim 7 in which the axial position of the necking dies of a plurality of consecutive modules varies by about 0.005 inch.

9. The method of claim 5 in which said axial spacing between the necking portion of the die and the necked-in portion of the container is about 0.005 inch.

10. The method of claim 5 in which the tapered neck of each of the necking dies forms an included angle with respect to an axis of the container which is engageable with the necking portion and the axial position of each of the necking dies is adjusted so that the included angle of the inwardly tapered necked-in portion of the container relative to the axis of the container is less than the included angle between the tapered neck and the axis of the container.

11. A method of necking an open end of a cylindrical metal container to produce a reduced diameter generally cylindrical portion and a smooth tapered portion above a cylindrical side wall comprising the steps of:

(a) forming a tapered necked-in portion on the end of the cylindrical side wall and a reduced diameter cylindrical portion adjacent said open end with the tapered necked-in portion having a first segment contiguous with said cylindrical side wall and a second segment contiguous with said reduced diameter portion, (b) engaging said reduced diameter cylindrical portion and not said tapered necked-in portion with a necking die having a first cylindrical surface substantially equivalent in diameter to said cylindrical side wall and a second cylindrical wall surface of a lesser diameter than said reduced diameter cylindrical portion and an intermediate wall surface between said first and second cylindrical wall surfaces, and (c) reforming only an upper part of the tapered necked-in portion and said reduced diameter cylindrical position to form a reformed necked-in portion having a reduced diameter generally cylindrical portion and a reformed smooth tapered portion, the intermediate wall surface of the necking die not engaging the reformed smooth tapered portion of the container during said reforming step.

12. The method of claim 11 including the step of engaging only said reduced diameter cylindrical portion and not said tapered neck portion with a second die having a first cylindrical small surface substantially equivalent in diameter to said cylindrical side wall and a second cylindrical wall surface of lesser diameter than the second cylindrical wall surface of said first-mentioned die and an intermediate wall surface between said first and second cylindrical surfaces, and reforming only an upper part of the reformed necked-in portion to form a twice reformed necked-in portion having a generally cylindrical portion and a twice reformed smooth tapered portion, the intermediate wall surface of the second necking die not engaging the twice reformed smooth tapered portion of the container during said reforming step.

13. The method of claim 11 in which said container includes a radiused portion joining said tapered necked-in portion and said reduced diameter cylindrical portion of said container and said necking die includes a radiused portion joining said intermediate wall portion and said second cylindrical wall surface of said necking die, the radiused portion of said necking die engaging the radiused portion of the container during said reforming step.

14. A method of necking an open end of a cylindrical metal container to produce a reduced diameter generally cylindrical portion and a smooth tapered portion above a cylindrical side wall comprising the steps of:

(a) forming a reduced diameter cylindrical portion adjacent said open end and a tapered necked-in portion between said reduced diameter cylindrical portion and said cylindrical side wall and a radiused portion between said reduced diameter cylindrical portion and said tapered necked-in portion, and (b) reforming said reduced diameter cylindrical portion and said tapered necked-in portion by engaging said reduced diameter cylindrical portion and not said tapered necked-in portion with a necking die having a first cylindrical surface substantially equivalent in diameter to said second cylindrical side wall and a second cylindrical wall surface of a lesser diameter than said reduced diameter cylindrical portion, an intermediate wall surface between said first and second cylindrical wall surfaces, and a radiused portion between said intermediate wall surface and said second cylindrical wall surface to form a reformed tapered necked-in portion, said intermediate wall surface of the necking die not engaging said reformed tapered necked-in portion.

15. The method of claim 14 in which during said engaging step the radiused portion of the die engages the radiused portion of the container.

* * * * *

UNITED STATES PATENT AND TRADEMARK OFFICE

CERTIFICATE OF CORRECTION

PATENT NO. : 5,775,161
DATED : July 7, 1998
INVENTOR(S) : Antonio Caleffi, et al It is certified that error appears in the above-indentified patent and that said Letters Patent is hereby corrected as shown below:

In Claim 14, column 10, line 46, delete "second".

Signed and Sealed this

Twenty-third Day of November, 1999

*Attest:*

Q. TODD DICKINSON

*Attesting Officer*

*Acting Commissioner of Patents and Trademarks*